US006021289A

United States Patent [19]

Yamauchi

[11] Patent Number: 6,021,289

[45] Date of Patent: Feb. 1, 2000

[54] NECESSARY TIME DISPLAY APPARATUS FOR IMAGE FORMING APPARATUS

[75] Inventor: Manabu Yamauchi, Toride, Japan

[73] Assignee: Canon Kabushiki Kaisha, Tokyo, Japan

[21] Appl. No.: 08/992,583

[22] Filed: Dec. 17, 1997

[30] Foreign Application Priority Data

Dec. 24, 1996 [JP] Japan ..... 8-343476

[51] Int. Cl.[7] ..... G03G 15/00

[52] U.S. Cl. ..... 399/87; 399/81; 358/434

[58] Field of Search ..... 399/87, 85, 82, 399/81, 75, 8; 358/434, 438, 439, 404, 441; 364/184, 185, 186

[56] References Cited

U.S. PATENT DOCUMENTS 4,816,864 3/1989 Tanaka et al. ..... 399/81
5,373,349 12/1994 Ito ..... 399/8

*Primary Examiner*—Matthew S. Smith
*Assistant Examiner*—Hoan Tran
*Attorney, Agent, or Firm*—Fitzpatrick, Cella, Harper & Scinto

[57] ABSTRACT

Whether there is an interruption of image forming operation until all images are copied is judged in advance in accordance with the number of originals, the number of copies, a copy mode, the number of bins of a sorter, and the like. If it is judged that there is an interruption, a necessary time taken to complete the image forming operation and a necessary time taken until an interruption are discriminably displayed.

14 Claims, 3 Drawing Sheets

NECESSARY TIME DISPLAY APPARATUS FOR IMAGE FORMING APPARATUS

BACKGROUND OF THE INVENTION

1. Field of the Invention

The present invention relates to a necessary time display apparatus for an image forming apparatus which apparatus displays a time taken to form images with an image forming apparatus.

2. Related Background Art

A conventional display device displays a time taken to copy images, in accordance with the input number of copies.

With this conventional method, however, a time taken to form images is displayed even in the case of interruption of image forming operation caused by the number of sorter bins smaller than the input number of copies. In this case, therefore, the displayed time is different from an actual time taken to form necessary images.

SUMMARY OF THE INVENTION

It is an object of the present invention to provide a necessary time display apparatus and a necessary time display method capable of solving the above problem.

It is another object of the present invention to provide a necessary time display apparatus and a necessary time display method capable of displaying a time taken until an interruption of image forming operation.

It is still another object of the present invention to provide a necessary time display apparatus and a necessary time display method capable of displaying both a time taken until an interruption of image forming operation and a time taken until a completion of image forming operation.

The other objects of the present invention will become apparent from the following description and claims when read in conjunction with the accompanying drawings.

DETAILED DESCRIPTION OF THE PREFERRED EMBODIMENT

An embodiment of the invention will be described with reference to the accompanying drawings.

Figure 1:
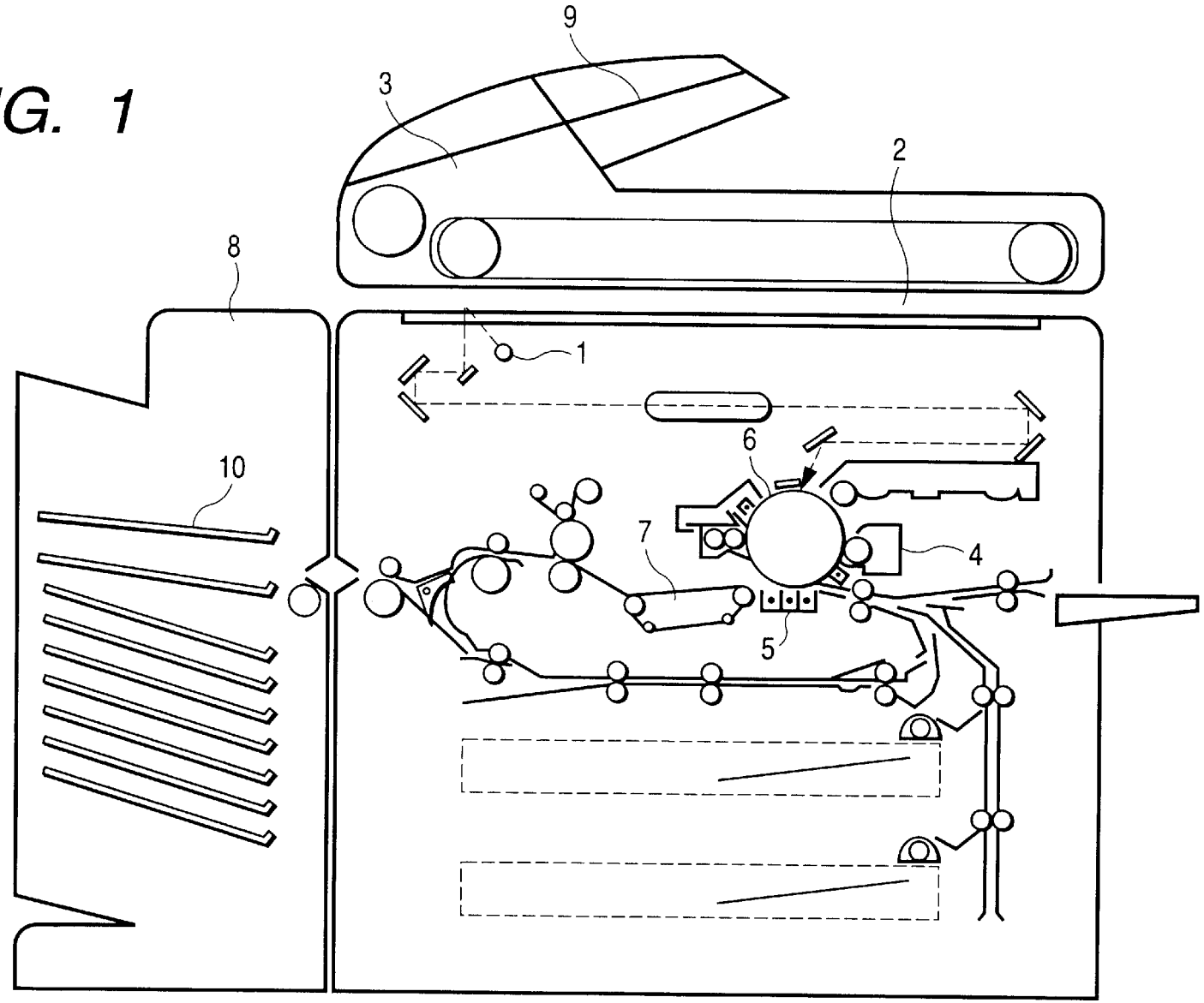
FIG. 1 is a cross sectional view of an image forming apparatus.

FIG. 1 is a schematic cross sectional view showing the internal structure of an image forming apparatus to which the invention is applicable. Reference numeral 1 represents an original illuminating lamp, reference numeral 2 represents an original placing glass plate, and reference numeral 3 represents an automatic original feeder of a known original circulating type which can count the number of set originals. Reference numeral 4 represents a developer, reference numeral 5 represents a transfer charger 5, reference numeral 6 represents a photosensitive drum, reference numeral 7 represents a fixing unit, reference numeral 8 represents a sorter, reference numeral 9 represents an original tray, and reference numeral 10 represents a paper eject tray. The sorter 8 has a plurality of paper eject trays for accommodating printed recording sheets.

An original set on the original tray 9 is fed to the original placing glass plate 2 by the automatic original feeder 3, and illuminated with the illuminating lamp 1 to form an electrostatic latent image of the reflected original image on the drum 6. This electrostatic latent image is developed with toner to visualize it. The toner image is transferred to a recording sheet by the transfer charger 5, heated and fixed with the fixing unit 7, and thereafter ejected onto one of the paper eject trays 10 of the sorter 8.

Figure 2:
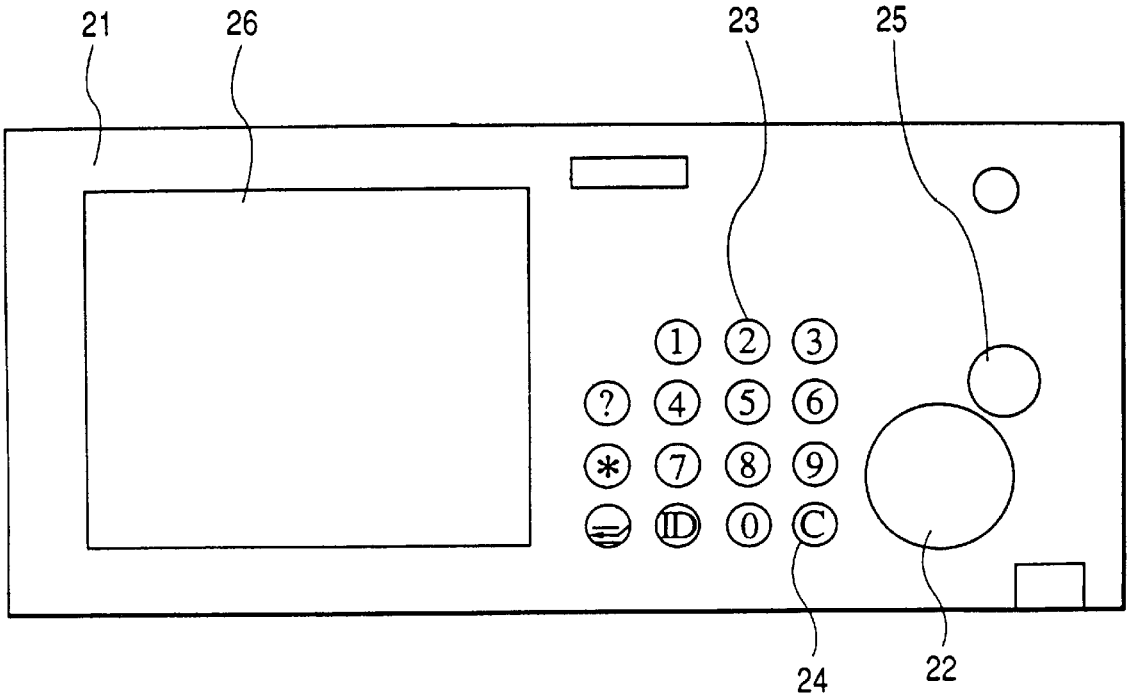
FIG. 2 is a diagram showing a console unit of the image forming apparatus.

FIG. 2 is a schematic diagram showing a console unit of the image forming apparatus. Reference numeral 21 represents a main frame of the console unit, reference numeral 22 represents a start key for instructing a copy operation start, and reference numeral 23 represents a ten-key for setting the number of image copies. The number of image forming operations per each copy may be one or two depending upon a copy mode set at that time. Reference numeral 24 represents a clear key for clearing the number set with the ten-key 23. Reference numeral 25 represents a stop key for stopping the image forming operation. Reference numeral 26 represents a display device including a liquid crystal display unit and a touch panel constituted of transparent electrodes, the display device being used for setting a copy mode, a type of recording sheet and a magnification factor and for displaying a necessary time taken to copy images and a numerical value set with the ten-key 23.

Figure 3:
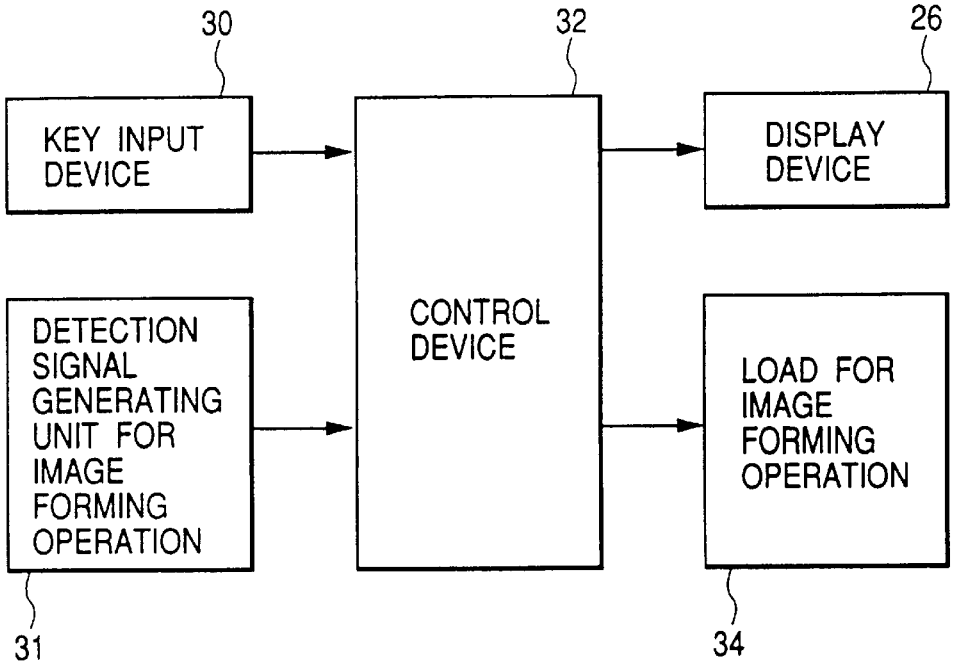
FIG. 3 is a block diagram showing an electronic circuit of the image forming apparatus.

FIG. 3 is a block diagram showing the outline of an electronic circuit of the image forming apparatus. Reference numeral 30 represents a key input apparatus corresponding to the above-described keys 22 to 25. An output of the key input apparatus is supplied to a control apparatus 32 constituted of a microcomputer, a memory and the like. Reference numeral 31 represents a detection signal generating unit for image forming operation. This detection signal generating unit includes unrepresented detectors for detecting the position of the original illuminating lamp 1, the size of an original, a presence/absence of a recording sheet, and the like, and supplies these detection signals to the control apparatus 32. Reference numeral 26 represents the above-described display device 26 including the touch panel, the display device 26 being controlled by a drive signal supplied from the control apparatus 32. Reference numeral 34 represents a load for image forming operation, such as motors, electromagnetic clutches and heaters for driving and controlling the original illuminating lamp 1, developing unit 4, transfer charger 5, photosensitive drum 6, fixing unit 7 and the like, the operation of the load being collectively controlled by the control apparatus 32.

Next, a method of judging whether there is an interruption of image forming operation will be described. For example, in a process of sorting printed recording sheets, if the number of set copies is larger than the number of paper eject trays 10 accommodated in the sorter 8, the image forming operation is once interrupted when copies are printed as many as the number of paper eject trays, and after the recording sheets on the trays are removed, the start key 22 is again depressed to resume the image forming operation. This function is called a limitless sort function. In the image forming apparatus with such a limitless sort function, if the number of copies set with the ten-key 23 and the like by a user is larger than the number of paper eject trays 10, the limitless sort function starts operating so that it is possible to judge in advance whether there is an interruption of image forming operation. It is also possible to judge that the image forming operation can be completed without interruption if the number of set copies is smaller than the number of paper eject trays 10. It is also possible to judge that there is an interruption of image forming operation, if the number of originals is set larger than the number of recording sheets which can be accommodated in each tray. The number of recording sheets which can be accommodated in an intermediate tray used for both-side copy can also be used for the judgement of a presence/absence of interruption.

After the image forming operation resumes, the judgements same as above can also be performed. In each of other conditions set, it is also possible to judge a presence/absence of an interruption of image forming operation, in accordance with the number of set copies, a copy mode, the number of originals, and the like.

Next, a method of calculating a necessary completion time taken to form all images will be described. In this embodiment, a necessary completion time taken to complete the image forming operation from the start to end thereof is calculated in accordance with a necessary time taken to form one copy of an image.

A necessary time t taken to form one copy of an image, which is definitely determined from an original size, a recording sheet size, a copy mode, and a magnification factor, is previously stored in a memory of the control apparatus 32. The number n1 of image forming operations to be performed during the period from the start to end thereof is calculated in accordance with the number of copies, a copy mode and the number of originals. If n2 is the number of image forming operations performed from the start of calculating the necessary completion time to the end thereof, the necessary completion time T taken to complete the image forming operation after the start of calculation is given by the following equation (1).

$$T=t\times(n1-n2) \quad (1)$$

Next, a method of calculating a necessary interruption time taken until an interruption of image forming operation will be described. In this embodiment, a necessary interruption time taken until an interruption of image forming operation after the start or restart of image forming operation is calculated in accordance with a necessary time taken to form one copy of an image. Similar to the equation (1), the necessary time t taken to form one copy of an image, which is definitely determined from an original size, a recording sheet size, a copy mode, and a magnification factor, is previously stored in the memory of the control apparatus 32. The number n3 of image forming operations to be performed during the period from the start to interruption thereof or during the period from the restart to interruption thereof is calculated in accordance with the number of copies, a copy mode, the number of originals and the number of paper eject trays. If n4 is the number of image forming operations performed from the start of calculating the necessary interruption time to the end thereof, the necessary interruption time T2 taken until an interruption of image forming operation after the start of calculation is given by the following equation (2).

$$T2=t\times(n3-n4) \quad (2)$$

Figure 4:
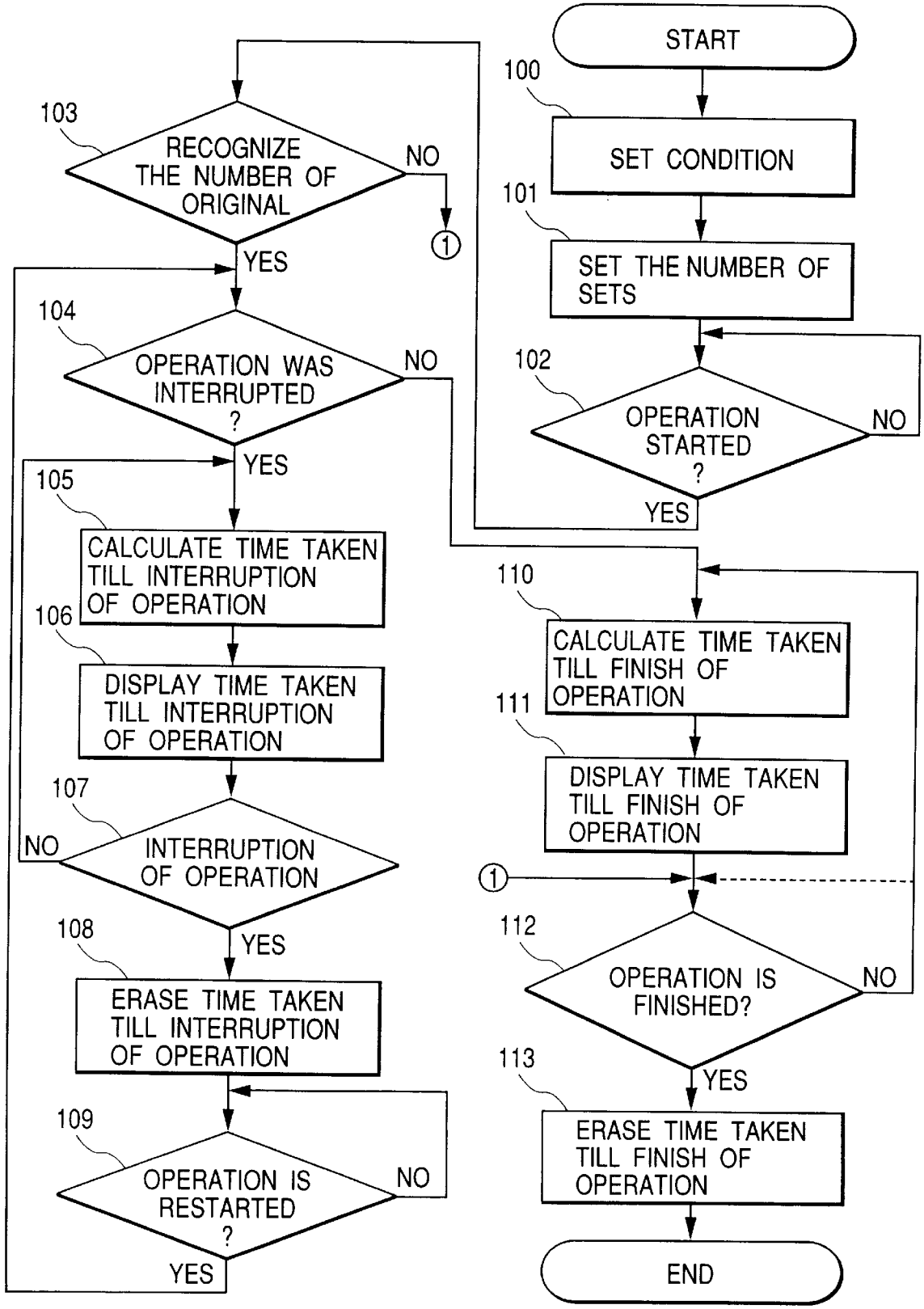
FIG. 4 is a flow chart illustrating the operation of a necessary time display apparatus.

FIG. 4 is a flow chart illustrating the process of displaying each necessary time. At Step 100 a user determines copy conditions by using the touch panel of display device 26, the copy conditions including a copy mode such as a both-side copy, a magnification factor, a type of recording sheet, and the like. At Step 101 a user sets the number of copies (sets) by using the ten-key 23. Next, at Step 102 it is checked whether the start key 22 is depressed, and if not, the flow stands by until it is depressed. The image forming operation is performed in parallel with the following processes, during the period from the depression of the start key to an interruption of the image forming operation. At Step 103, it is checked whether the number of originals is input from the touch panel of display device 26 or ten-key 23 or whether it is automatically counted by the original feeder 3. If the number of originals is set by the manual input or by automatic count, the flow advances to Step 104, whereas if not, the flow advances to Step 112. In the automatic count, if a copy mode is a mode of copying a plurality of one-side originals to a plurality of both-side recording sheets, the originals are circulated without copying in order for the original feeder 9 to count the necessary number of image forming operations.

At Step 104, it is judged from the number of originals, the number of copies, a copy mode, the number of bins of the sorter, and the like whether there is an interruption of image forming operation before all images are copied. If there is an interruption, the flow advances to Step 105, whereas if not, the flow advances to Step 110.

At Step 105 the necessary interruption time is calculated by the above-described necessary time calculating method given in the form of the equation (2). If there is a predictable error of the necessary interruption time, a correction calculation is performed. At Step 106 the calculated necessary interruption time is displayed on the display device 26. In this embodiment, the time is displayed in the unit of minute. For example, if the necessary interruption time is 3 minutes, a character string "3 minutes remain" is displayed on the display device 26.

At Step 107 it is checked whether the image forming operation is interrupted. If not, the flow returns to Step 105, whereas if interrupted, the flow advances to Step 108 whereat the necessary interruption time displayed on the display device 26 is erased. At Step 109 it is checked whether the start key 22 is depressed to restart the interrupted image forming operation, and if not, the flow stands by until it is depressed. After the image forming operation resumes, the flow returns to Step 104 whereat it is checked whether there is an interruption until all images are completely copied after the restart of the image forming operation. If there is an interruption, the flow advances to Step 105 to calculate the necessary interruption time. The processes from Step 104 to Step 105 are repeated until it is judged that there is no interruption of image forming operation.

If there is no interruption at Step 104, the flow advances to Step 110 whereat the necessary completion time is calculated. Similar to the calculation of the necessary interruption time at Step 105, the necessary completion time is calculated by the a above-described necessary completion time calculating method given in the form of the equation (1). If there is a predictable error of the necessary completion time, a correction calculation is performed. At Step 111 the calculated necessary completion time is displayed on the display device 26. At Step 112 it is checked whether the image forming operation is completed. If not, the flow returns to Step 110. If the necessary completion time is made not to be displayed, the flow stands by until the image forming operation is completed as indicated by a broken line in FIG. 4. If the image forming operation is completed, the flow advances to Step 112 whereat the necessary completion time displayed on the display device 26 is erased.

Although only the necessary interruption time is calculated at Step 105, both the necessary interruption time and the necessary completion time may be calculated at Step 105 and displayed on the display device 26 at Step 106 to improve the functionality of the apparatus.

As described so far, if it is judged that there is an interruption of image forming operation, the necessary interruption time is displayed or both the necessary interruption time and the necessary completion time are displayed at the same time. Accordingly, a user can efficiently perform image forming operations and the functionality of the image forming apparatus can be improved.

The invention is not limited only to the above embodiment, but various modification are possible without departing from the scope of the appended claims.

What is claimed is:

1. A necessary time display apparatus for an image forming apparatus, comprising:

setting means for setting an image forming mode;

judging means for judging from the image forming mode set by said setting means whether an interruption of image forming operation will occur;

determining means for determining, after the image forming mode is set, a time taken until an interruption of image forming operation, if said judging means judges that an interruption will occur; and display means for displaying the determined time.

2. A necessary time display apparatus according to claim 1, wherein said determining means further determines a necessary completion time taken to complete image forming operation, and said display means displays both the determined time and the determined necessary completion time.

3. A necessary time display apparatus according to claim 1, wherein said determining means determines a necessary completion time taken to complete image forming operation after a restart of image forming operation, and said display means displays the necessary completion time taken to complete image forming operation after the restart of image forming operation.

4. A necessary time display apparatus according to claim 1, wherein if said judging means judges that no interruption of image forming operation will occur, said display means displays the image completion time.

5. A necessary time display apparatus according to claim 1, wherein said judging means judges whether an interruption of image forming operation will occur in accordance with the number of image copies to be formed.

6. A necessary time display apparatus according to claim 5, wherein if the image forming apparatus has sorting means connected thereto and has a plurality of trays for sorting image formed recording sheets, said judging means judges whether an interruption of image forming operation will occur in accordance with the number of image copies to be formed and the number of trays.

7. A necessary time display method for an image forming apparatus, comprising the steps of:

(a) determining an image forming mode set by a user;

(b) judging from the determined image forming mode whether an interruption of image forming operation will occur;

(c) obtaining, after the set image forming mode is determined, a time taken until an interruption of image forming operation, if it is judged that an interruption of image forming operation will occur; and (d) displaying the obtained time on a display device.

8. A necessary time display method according to claim 7, wherein said step (c) further obtains a necessary completion time taken to complete image forming operation, and said step (d) displays on the display device both the obtained time and the obtained necessary completion time.

9. A necessary time display method according to claim 7, further comprising the steps of:

obtaining a necessary completion time taken to complete image forming operation after a restart of image forming operation; and displaying the necessary completion time taken to complete image forming operation after the restart of image forming operation.

10. A necessary time display method according to claim 7, wherein if said step (b) judges that no interruption of image forming operation will occur, said step (d) displays the image completion time on the display device.

11. A necessary time display method according to claim 7, wherein said step (b) judges whether an interruption of image forming operation will occur in accordance with the number of image copies to be formed.

12. A necessary time display method according to claim 11, wherein if the image forming apparatus has sorting means connected thereto and has a plurality of trays for sorting image formed recording sheets, said step (b) judges whether an interruption of image forming operation will occur in accordance with the number of image copies to be formed and the number of trays.

13. A necessary time display apparatus for an image forming apparatus, comprising:

setting means for setting an image forming mode;

judging means for judging from an image forming mode set by said setting means whether there is an interruption of image forming operation;

determining means for determining a necessary interruption time taken until an interruption of image forming operation, if said judging means judges that there is an interruption; and display means for displaying the determined necessary interruption time;

wherein said determining means determines a necessary completion time taken to complete image forming operation after a restart of image forming operation, and said display means displays the necessary completion time taken to complete image forming operation after the restart of image forming operation.

14. A necessary time display method for an image forming apparatus, comprising the steps of:

(a) determining an image forming mode set by a user;

(b) judging from the determined image forming mode whether there is an interruption of image forming operation;

(c) obtaining a necessary interruption time taken until an interruption of image forming operation, if it is judged that there is an interruption of image forming operation;

(d) displaying the obtained necessary interruption time on a display device;

(e) obtaining a necessary completion time taken to complete image forming operation after a restart of image forming operation; and (f) displaying the necessary completion time taken to complete image forming operation after the restart of image forming operation.

* * * * *

UNITED STATES PATENT AND TRADEMARK OFFICE

CERTIFICATE OF CORRECTION

PATENT NO. : 6,021,289

DATED : February 1, 2000

INVENTOR : Manabu Yamauchi

It is certified that error appears in the above-identified patent and that said Letters Patent is hereby corrected as shown below:

COVER PAGE

Under [56] References Cited, U.S. Patent Documents, please insert --5,809,371 9/1998 Inui et al. 399/81--.

Under [56] References Cited, Foreign Patent Documents, please insert the following:

| | | |
|---|---|---|
| -- 468762 | 1/1992 | Europe |
| 714058 | 5/1996 | Europe |
| 3-85557 | 4/1991 | Japan |
| 4-298785 | 10/1992 | Japan |
| 7-175371 | 7/1995 | Japan |
| 10-228214 | 8/1998 | Japan |
| 10-186963 | 7/1998 | Japan --. |

IN THE DRAWINGS

Sheet 3, Figure 4, "ORIGINAL" should read --ORIGINALS--.

COLUMN 1

Line 8, "apparatus" (second occurrence) should be deleted.

COLUMN 2

Line 32, "con-" should read --comprising--; and
Line 33, "stituted" should be deleted.

UNITED STATES PATENT AND TRADEMARK OFFICE

CERTIFICATE OF CORRECTION

PATENT NO. : 6,021,289

DATED : February 1, 2000

INVENTOR : Manabu Yamauchi

It is certified that error appears in the above-identified patent and that said Letters Patent is hereby corrected as shown below:

COLUMN 4

Line 52, "a" should be deleted.

COLUMN 5

Line 11, "modification" should read --modifications--.

Signed and Sealed this

Twentieth Day of March, 2001

*Attest:*

Nicholas P. Godici

NICHOLAS P. GODICI

*Attesting Officer*

*Acting Director of the United States Patent and Trademark Office*